United States Patent [19]

Rojey

[11] Patent Number: 4,749,336

[45] Date of Patent: Jun. 7, 1988

[54] INDUCED ROTATION EJECTOR

[75] Inventor: Alexandre Rojey, Garches, France

[73] Assignee: Institut Francais du Petrole, Rueil-Malmaison, France

[21] Appl. No.: 52,391

[22] Filed: May 21, 1987

[30] Foreign Application Priority Data

May 22, 1986 [FR] France ..... 86 07444

[51] Int. Cl.[4] ..... F04F 1/18

[52] U.S. Cl. ..... 417/54; 417/163; 417/169; 417/171; 366/177

[58] Field of Search ..... 417/54, 171, 169, 163, 417/161, 68; 366/150, 173, 177

[56] References Cited

U.S. PATENT DOCUMENTS

| | | | |
|---|---|---|---|
| 3,046,732 | 7/1962 | Foa | 417/171 |
| 3,371,618 | 3/1968 | Chambers | 417/163 |
| 4,074,954 | 2/1978 | Roberts | 417/68 |

*Primary Examiner*—Robert E. Garrett
*Assistant Examiner*—John T. Kwon
*Attorney, Agent, or Firm*—Antonelli, Terry & Wands

[57] ABSTRACT

A process and device for compressing a fluid by releasing a working fluid that includes an initial pocket wherein the working fluid circulates, a second pocket in which the fluid to be compressed circulates, a third pocket wherein the mixture of the working fluid circulates along with the fluid to be compressed, with the mixture being supplied from a mixing pocket that is connected to the third pocket as well as to the first and second pockets. The mixing pocket has a ring-like configuration and the first and second pockets are connected to the mixing pocket through passages that are adapted to introduce the working fluid and fluid to be compressed substantially tangentially. The device is adaptable to compress or pump an effluent which is of an oil type nature.

13 Claims, 4 Drawing Sheets

INDUCED ROTATION EJECTOR

BACKGROUND OF THE INVENTION

The present invention relates to an ejecting process and a device for at least one of compressing or pumping a fluid, with the device having a small clearance.

Generally speaking, ejectors represent a simple cost effective means with regard to investments for compressing a fluid; however, prior art ejectors have a number of disadvantages thereby restricting potential application.

The disadvantage of the prior art ejectors are, for example, significant linear clearance, reduced energy output, and reduced operating range.

The aim underlying the present invention essentially resides in providing an ejecting device and process which avoids, by simple means, shortcomings and disadvantages encountered in the prior art.

According to advantageous features of the present invention, a device is proposed which compresses a fluid by releasing a working fluid which includes an initial pocket in which the working fluid circulates, a second pocket wherein the fluid to be compressed circulates, a third pocket in which the mixture of the working fluid and the fluid to be compressed circulates, with the mixture stemming from a mixing pocket connected to the third pocket as well as to the first and to the second pockets.

Advantageously, according to the present invention, the mixing pocket includes a ring-like shape, with the first and second pockets being connected to the mixing pocket by way of passages adapted in such a manner so as to tangentially insert the working fluid and the fluid to be compressed inside the mixing pocket or ring-like pocket.

The above features may be carried out if the axes of the passageways which connect the first and second pockets are substantially tangential to the mixing pocket. The ring-like pocket, which has an average outer diameter and average inner diameter that define it, are such that a ratio of the average outer diameter of the ring-like zone and a distance between the average outer diameter and the average inner diameter are at least equal to five.

The second pocket for distributing the fluid to be compressed includes a circular crown pierced with channels which lead onto the ring-like pocket, with the channels being preferably placed at regular intervals on a perimeter of the ring-like pocket, and curved so that the fluid to be compressed can be inserted at a substantially tangential speed inside the ring-like zone.

The third pocket for compressing the mixture of the two fluids coming from said ring-like pocket includes a ring-like space itself inside which rectifying bladings are arranged that are adapted to gradually cancel the tangential speed component of the mixture by allowing pressure to rise.

The first pocket for distributing the working fluid can include a series of converging nozzles that lead inside the ring-like pocket, with the nozzles being preferably placed at regular intervals on the perimeter of the ring-like pocket and tilted so that the working fluid can be inserted at a substantially tangential speed inside the ring-like pocket.

The first pocket for distributing working fluid can include a circular crown pierced with channels that lead onto the ring-like pocket, with the channels being preferably placed at regular intervals on the perimeter of the ring-like pocket with a converging shape so as to communicate to the working fluid an increasing speed, and also with a curved shape so as to insert the fluid to be compressed at a substantially tangential speed inside the ring-like pocket.

The first pocket for distributing the working fluid can include a ring-like zone included between two conical surfaces of which the generators can form a different angle with the axis of the device so as to produce the converging ring-like zone in which the working fluid will be inserted by a tangential intake at the level of the largest section and it will circulate at an increasing tangential speed up to the smallest section which communicates with the ring-like pocket.

The third pocket for compressing the mixture of the two fluids coming from the ring-like pocket can include, itself, a ring-like zone included between two conical surfaces of which the generators can form a different angle with the axis of the device, so as to produce said diverging ring-like zone in which the mixture of the two fluids coming from the ring-like pocket leads to the level of the smallest section and circulates at a decreasing tangential speed up to the largest section.

The third pocket can include an initial space included between two surfaces arranged more or less crosswise in relation to the axis of the device in which the mixture can circulate at a decreasing tangential speed by being discharged at the periphery of the initial space, with the initial space being followed by a second space which is also included between two surfaces that arranged in a roughly crosswise manner in relation to the axis of the device in which the mixture is brought back towards the axis of the device by circulating at a decreasing tangential speed, the second space can be fitted with rectifying blades that make it possible to gradually cancel the tangential speed of the mixture.

The angle for inserting the working fluid inside the initial pocket for distributing the working fluid can be altered when the debit of said working fluid varies, so as to sustain the tangential circulation speed of the working fluid at a substantially constant valve.

The device according to the invention can be used to compress gas or vapor or to compress a liquid.

The working fluid can be comprised of a gas or vapor, or still a liquid.

The present invention also relates to a compression process for a fluid by releasing a working fluid. In accordance with the present invention, a process is proposed which includes the steps of introducing a working fluid inside an initial zone wherein the working fluid circulates inside a decreasing passageway section at an increasing speed, and exiting the initial zone at a pressure level which is lower than a pressure level of the low pressure fluid to be compressed. At an exit of the initial zone, the working fluid is lead into a ring-like zone in a substantially tangential direction and, along a substantially tangential direction the low pressure fluid to be compressed is lead into the ring-like zone by feeding the same through a second zone. The working fluid inside the second zone with the fluid to be compressed is mixed by introducing a mixture of a tangential speed which is substantially uniform inside the entire ring-like zone and such mixture is supplied into a third zone wherein the tangential speed is gradually cancelled, with the pressure rising in a correlative way.

The present invention will be better understood from the following description when taken in connection with the accompanying drawings which show, for the purpose of illustration only, several embodiments in accordance with the present invention.

DETAILED DESCRIPTION

Figure 1:
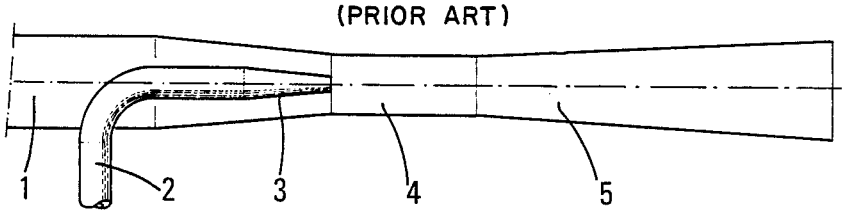
FIG.1 (PRIOR ART)
FIGS. 1 and 2 are schematic views of ejectors constructed in accordance with the prior art.

Referring now to the drawings wherein like reference numerals are used throughout the various views to designate like parts and, more particularly, to FIG. 1, according to this figure, the fluid to be compressed in an ejection device is supplied through a suction duct 1, with the compression being accomplished by a working fluid which is introduced through a duct 2. In a converging piece 3, a speed of the working fluid increases and correlatively a pressure drop is experienced.

The fluid to be compressed and the working fluid can thus be admitted inside the mixing zone 4 at the same pressure level. Inside the mixing zone 4 there is an exchange of quantity of motion between the working fluid and the fluid to be compressed and at the output of the mixing zone the range of speeds can be viewed as substantially uniform.

The speed of the mixture of the two fluids is reduced inside the diffuser 5 and correlatively the pressure rises. The device makes it possible to compress the fluid that is supplied from the duct 1 by releasing, in part, the working fluid which is supplied from the duct 2.

As noted hereinabove, an ejection device of the type described above contains a number of advantages. More particularly, the device is totally static and, consequently, makes the device totally reliable. Moreover, the device does not need a lubricant and is not subject to risks of leaks by virtue of bearings of the compressors fitted with a rotor.

Furthermore, the proposed device is simple and cost effective to manufacture which, as can be appreciated, is especially significant in an effort to reduce the overall manufacturing and operating costs.

Furthermore, a device of the aforementioned type may be readily utilized with a various liquid or gaseous fluid such as, for example, a gas-gas ejecto-compressor such as described in French Patent Application No. 85/0944 which proposes head vapor compression with such a device which comes from distilling.

However, aside from the above-noted advantages, a number of disadvantages exist with regard to the above described devices which limit the use thereof. More particularly, the energy output is reduced as a result of losses through friction, with the losses basically taking place inside the mixer and the diffuser. In the mixer, the losses through friction account for 5% to 15% of kinetic energy in the mixture, with the losses being tied to heterogeneity of the range of speeds at the input of the mixer and, the mixer must have a sufficient length so as to homogenize that range of speeds.

The most significant losses occur in the diffuser, and the diffuser generator must not produce an angle with the access that is greater than about 7°, by virtue of the risk of destabilizing the outflow and hence the length of the diffuser is significant with respect to the diameter. In this connection, losses of 15% to 60% of kinetic energy in the mixture may be incurred in accordance with the section ratio and the adopted technique.

Furthermore, because those losses pertain to the kinetic energy of the mixture, the greater the increase of the dilution factor of the working fluid by the driven fluid, the lower the output, where a gradually smaller share of work in the release of working fluid is transformed into compression work for the driven fluid.

Another difficulty lies in the fact that, with a partial load, the sections are no longer suited for the debits that circulate inside the device. Hence, the operating range is fairly narrow and in order to make the debit vary of the fluid to be compressed, one has to have a battery of ejecto-compressors which can be activated in succession.

In order to be able to reduce the length of the diffuser, a proposal has been put forth to produce, in the intake zone of the working fluid and inside the starting zone of the mixture, a swirling motion of which the speed increases by coming closer to the axis of the device through conservation of the quantity of the motion. Such a swirling motion is produced by introducing the working fluid tangentially inside the converging part of the device. Such devices are the subject especially of U.S. Pat. No. 4,245,961 and Soviet patents SU-A Nos. 731220 and 1.125.417.

Figure 2:
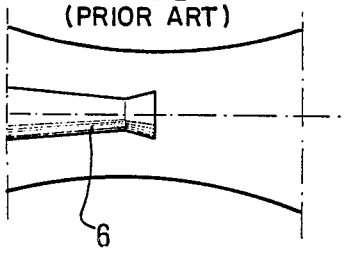
FIG.2 (PRIOR ART)

As shown in FIG. 2, the fluid to be compressed which arrives through the nozzle 6 leads to the center of the swirl which is produced by the working fluid.

Such an arrangement makes it possible to cut down the length of the diverging substance, but it leads to an increase in the heterogeneity of the range of speeds which does not favor output.

Figure 3:
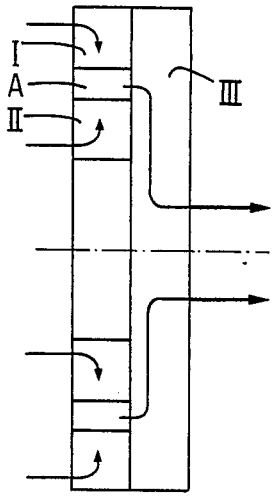
FIG. 3 is a flow diagram of the process according to the present invention.

As shown in FIG. 3, the principles of the present invention include allowing a working fluid inside an initial zone I, or an initial pocket, where the working fluid circulates inside a decreasing passage section at an increasing speed, and existing the initial zone I at a pressure lower than the pressure of the low pressure fluid to be compressed. The working fluid is allowed, at an output of the initial zone I to be lead into a ring-like zone A or a ring-like pocket in a substantially tangential direction. The low pressure fluid to be compressed is allowed to be guided according to a substantially tangential section in the ring-like zone A through a second zone II or second pocket. The working fluid and low pressure fluid to be compressed are mixed inside the ring-like zone by assigning to the mixture a tangential speed which is substantially uniform throughout the ring-like zone A. This last described mixture goes into a third zone III or third pocket where the tangential speed is gradually cancelled as the pressure rises correlatively.

It has also been found that, in order to favor a range of tangential speeds which are substantially uniform inside the ring-like zone A, which makes it possible to reduce the losses through friction in the ring-like zone, it is preferable that the interval between the average outer diameter of the ring-like zone A and the average inner diameter of the ring-like zone A should be reduced relative to the average outer diameter, the ratio of the average outer diameter of the ring-like zone A to the interval between the average outer diameter and the average inner diameter of the ring-like zone A preferably greater than five.

The respective positions of the first and second zones I and II can be altered.

Hence, the first zone I for inserting the working fluid can be placed inside said ring-like space and the second zone II for inserting the low pressure fluid to compress outside of said ring-like space. Thus, the zones I and II are placed at different diameters. Under specific circumstances, the first and second zones I and II can even be located on the same side of the ring-like zone A, as shown in the following implementation examples.

Figure 4A:
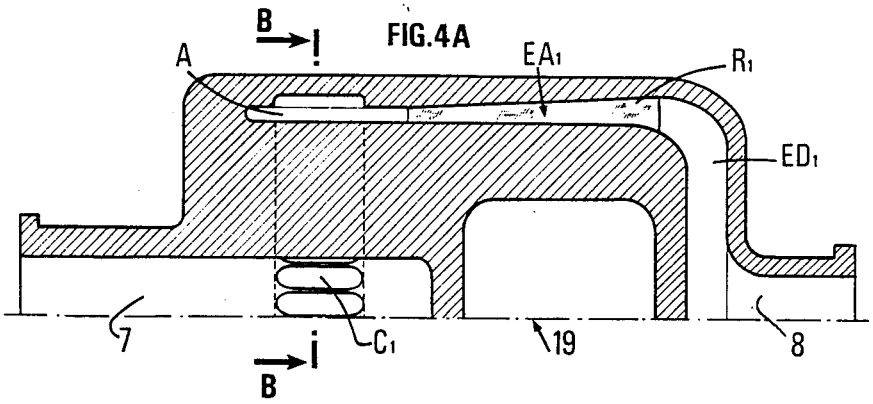
FIGS. 4A and 4B are partial cross-sectional views of a device constructed in accordance with the present invention.
Figure 4B:
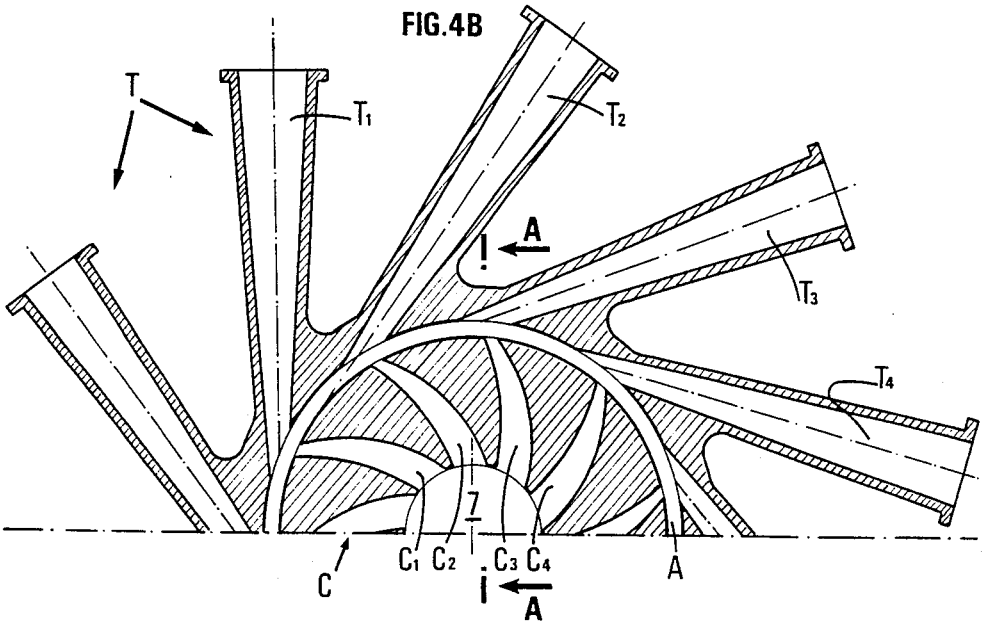

A first implementation example of the device according to the invention is depicted in diagrams of FIGS. 4A and 4B.

FIG. 4A depicts a lengthwise section of the device according to plane A—A shown in FIG. 4B and FIG. 4B a cross section of the device by plane B—B shown in FIG. 4A.

The low pressure fluid to compress comes in through duct 7. Then it is distributed through a circular crown C which depicts in that implementation example the second distribution zone II. In that circular crown it is distributed according to a series of canals like C1, C2, C3, C4 placed more or less radially and positioned at regular intervals. Those canals converge, in other words their section decreases towards the periphery of said circular crown, in order to communicate an increasing speed to the low pressure fluid to compress and are curved so as to insert the low pressure fluid to compress with a speed that is more or less tangential inside the ring-like zone A.

The working fluid comes in by a series of converging nozzles such as T1, T2, T3. In that implementation example those nozzles T depict the initial distribution zone I of the working fluid. The intake nozzles T of the working fluid converge, in order to communicate increasing speed to the working fluid, while reducing its pressure, so as to bring it to a level that is lower than that of the fluid to compress and are tilted so as to insert the working fluid at a tangential speed inside the ring-line zone A.

Preferably, the orifices which are located on either side of the ring-like zone A, by which the canals lead out respectively such as C1, C2, and C3 and the nozzles such as T1, T2 and T3 are arranged face to face.

The working fluid and the low pressure fluid to compress are mixed inside the ring-like zone A and the mixture of those two fluids circulates with a gyratory motion at an average speed which is more or less uniform along the entire circumference of the ring-like space A and the entire passage section of the ring-like space A.

Figure 4C:
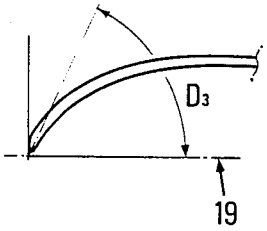
FIG. 4C is a detail view of the device of the present invention.

Then, the mixture of the two fluids leads onto a ring-like space EA1 which extends the ring-like space A wherein rectifying blades R1 are arranged which make it possible to gradually cancel the tangential element of the speed of the mixture, the pressure of which rises correlatively. The profile of one of those bladings R1 is depicted in FIG. 4C.

At the intake of the mixture inside the ring-like space EA1, the blade forms an angle D3 with the longitudinally axis 19 of the device which is close to 90°. That angle then gradually drops as it gets closer to a zero value, so as to gradually reduce the tangential speed of the mixture.

The mixture is thus compressed. Afterwards it is discharged through the space ED1 towards the discharge duct 8.

The first, second and third zones I, II and III can be executed with different geometries, while being in conformance with the principle of the invention.

Figure 5:
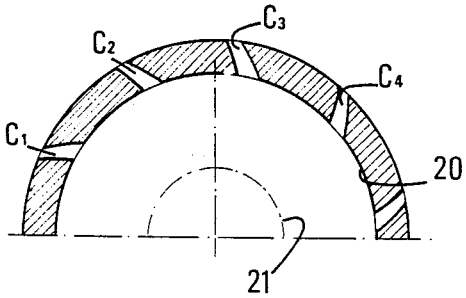

The inner diameter of the circular distribution crown C of the low pressure fluid to compress can differ from the intake duct 7. Especially when the inner diameter is increased, the width of the circular crown which is displayed according to the diagram of FIG. 5 is reduced, so that it is possible to simplify its execution. Reference 20 in FIG. 5 depicts the outer diameter of the circular crown C and reference 21 designates the dotted line which corresponds to the track of the intake duct 7.

The geometry which is diagrammed in FIGS. 4A, 4B and 4C is especially advantageous when the low pressure fluid to be compressed is admitted inside the ring-like space A at a fairly low speed.

In the opposite case, it is preferable to gradually communicate that speed so as to avoid a fairly significant load loss at intake. This is executed by gradually altering the section of the canals such as Cl, C2, C3, which implies a sufficient length for those canals and a fairly wide distribution crown.

Figure 6:
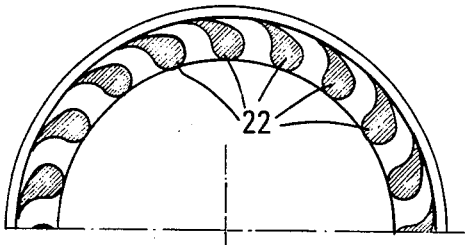
FIGS. 5–7 are partial cross-sectional views of a variation of a device constructed in accordance with the present invention.

The distribution crown of the low pressure fluid can be executed either by emptying canals on a full piece, or with blades 22 which make it possible to tangentially direct the fluid according to the diagram in FIG. 6.

Another possibility involves distributing the low pressure fluid to compress according to a series of nozzles arranged regularly like canals such as Cl, C2, C3 and tilted in order to allow the low pressure fluid to end up inside the ring-like space A at a tangential speed.

The distribution of the working fluid inside the first zone I can also be executed differently from that which was previously described.

Figure 7:
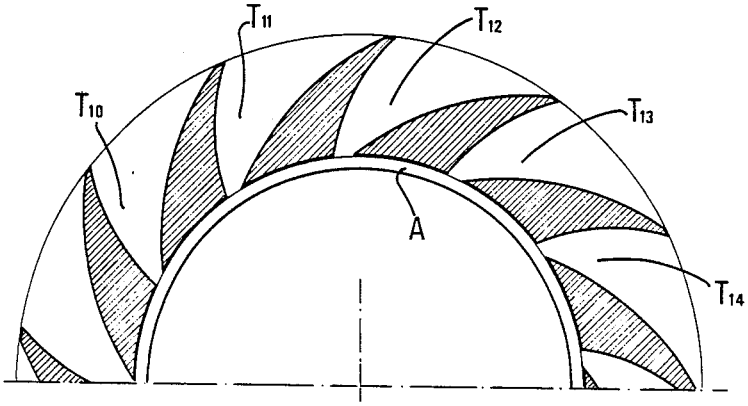

The working fluid can be distributed through a circular crown such as the one which is diagrammed in FIG. 7. In that circular crown it is distributed according to a series of canals such as T10, T11, T12, T13, T14 radially arranged and positioned at regular intervals. Those canals converge, in other words their section decreases towards the inside of said circular crown so as to communicate an increasing speed to the working fluid and they are curved so as to insert the working fluid at a more or less tangential speed inside the ring-like zone A.

Figure 8:
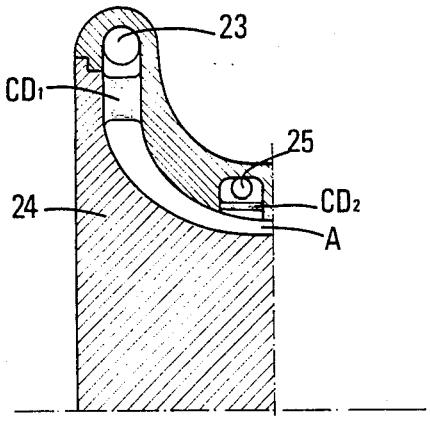
FIGS. 8, 9A, and 9B are partial cross-sectional views depicting the first and second zones of a device constructed in accordance with the present invention.

The inner diameter of the distribution crown can be greater than the inner diameter of the ring-like zone A and the distribution crown can be shifted lengthwise in relation to the ring-like zone A, as shown in the execution diagram of FIG. 8. In that execution example the working fluid comes in tangentially through the opening 23. It joins together the ring-like mixing zone and the low pressure fluid through the curved ring-like zone 24. The intermediate ring-like zone 24 possesses a converging shape, which allows it to increase the tangential speed of the working fluid. Reference CD1 designates the distribution crown of the working fluid which will preferably include blades.

The low pressure fluid to compress comes in through duct 25. It is allowed to rotate inside the distribution crown CD2 and mixes with the working fluid inside the ring-like zone A. That crown will be able to include preferably blades. In that example the first two distribution zones I and II are positioned radially on the same side of the ring-like zone A.

A converging ring-like zone, like the intermediate ring-like zone 24 with a tangential intake, can also replace the multi-nozzle system, like the one depicted in FIG. 5, or a distribution crown, like the one depicted in FIG. 7.

Figure 9B:
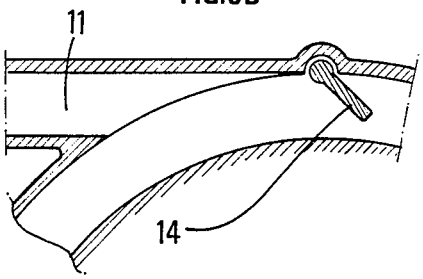
Figure 9A:
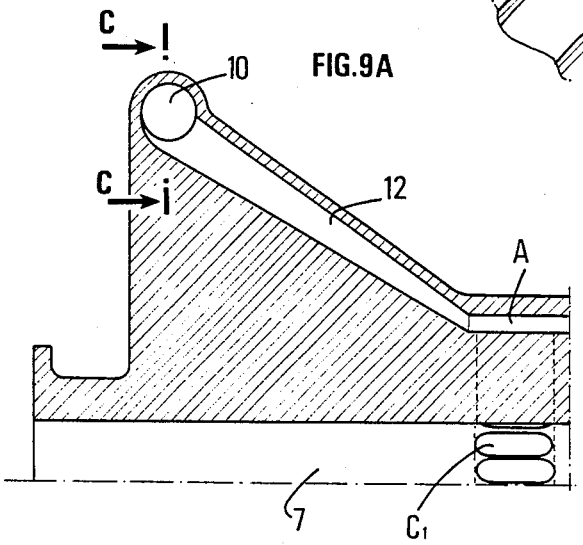

Such a distribution is depicted in FIG. 9A. The working fluid arrives tangentially through the opening 10. Then it goes into the ring-like zone 12 which is included between two conical surfaces with different angles, so as to form a converging ring-like zone wherein the tangential speed of the working fluid increases because the restriction of the cross section to the tangential outflow of the working fluid.

The device according to the invention displays the advantage of being used inside a wide range of debits.

Indeed, the tangential speed inside zone I of working fluid distribution can be modulated, contrary to the lengthwise speed which occurs as a result of the ratio of the debit to the passage section which is perpendicular to the axis of the device.

Thus, if we consider the implementation mode which is diagrammed in FIG. 9A, for a set debit of working fluid, a variable tangential speed can be obtained by making the introduction angle vary of the intake duct 11 which leads into the opening 10.

Conversely, a constant tangential speed can be obtained for a variable working fluid debit by making that same introduction angle vary.

A comparable effect can be obtained, not by modifying the introduction angle of the intake duct 11, but by altering the position of a shutter which leads more or less to reducing the outflow tangential speed.

The tangential intake of the working fluid through the conduit 11 is diagrammed according to a cross section in FIG. 9B.

The shutter 14 is an adjustable shutter which makes it possible to maintain the constant tangential speed, even when the working fluid debit varies. That shutter is raised when the working fluid debit drops, in order to compensate for the reduction of speed at which the working fluid leads into the ring-like space 12 through the opening 10 and lowered when the working fluid debit increase in order to compensate for the increase in speed at which the working leads into the ring-like space 12 through the opening 10. Thus, the device according to the invention can function on an extended debit array. In FIG. 9A, distribution of fluid to compress can be executed roughly in the same way as that which is depicted in FIGS. 4B and 4C.

Different positions for the shutter 14 along the periphery of the ring-like section can be anticipated. The shutter 14 can turn either around an axis that is more or less parallel to the axis of the device or around an axis which is perpendicular to the axis of the device. Finally, several shutters can be arranged so as to obtain a direction effect for the speed which is better allotted along the periphery of the ring-like section.

The third compression zone III of the mixture which is produced in the ring-like zone A by the working fluid and the low pressure fluid can also take on a different configuration from that which is depicted in FIG. 4A.

Figure 10:
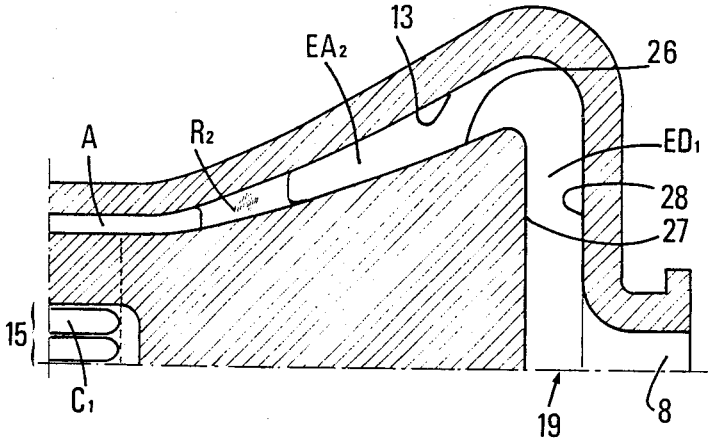
FIGS. 10 and 11A are cross-sectional views of a third zone of a device constructed in accordance with the present invention.

Another geometry example of the third zone III is depicted in FIG. 10.

The working fluid mixes with the low pressure fluid which comes in through the duct 15 inside the ring-like space A. The mixture of the two fluids flows inside the ring-like space EA2 which is included between two surfaces which are more or less conical 13 and 26 of which the generators form a different angle with the axis of the device, so as to create a ring-like diverging zone wherein the mixture of the two fluids coming from the ring-like zone A leads at the level of the smallest section and circulates at a decreasing tangential speed in the direction of the largest section. In the implementation mode which is depicted, the ring-like zone EA2 is fitted, on part of its length, with rectifying blades R2 that are designed to favor the slowing down of the tangential speed. Those rectifying blades can be omitted in some instances, in order to simplify the manufacture of an apparatus which operates according to the principle of the device according to the invention.

Then, the mixture of the two fluids is brought back towards the axis 19 of the device by circulating inside the space ED2 which is included between two surfaces 27 and 28 that are positioned more or less perpendicular to the axis of the device and is discharged by way of duct 16.

The angle formed by the generators of the conical surfaces between which the space EA2 is included with the axis 19 of the device preferably varies and increases gradually along that axis by taking into account the circulation direction of the fluid.

For the purpose of making the device more compact and at the same time reducing the losses through friction inside the third compression zone III, it is possible to reduce the length of the space EA2 by increasing the angle which are formed by the generators of spaces between which said space is included up to a value close to 90°.

Figure 11A:
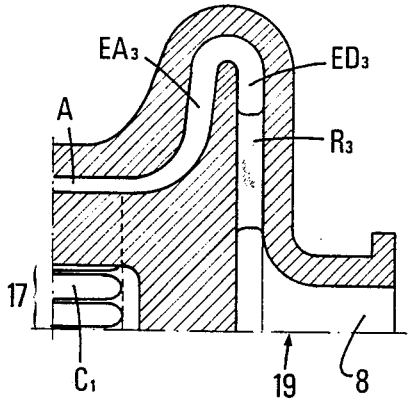
Figure 11B:
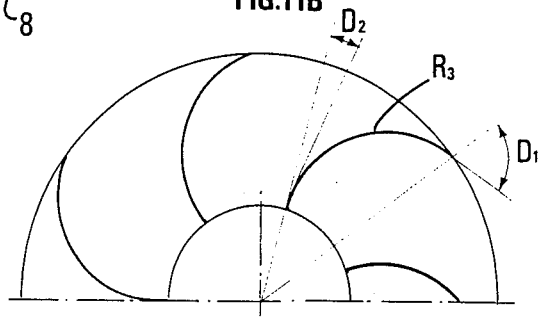
FIG. 11B is a schematic view of the device of FIG. 11A.

As shown in FIG. 11A working fluid mixes with the low pressure fluid that comes through duct 17 inside the ring-like space A. The mixture of the two fluids flows into the space EA3 which is included between two surfaces that are positioned more or less perpendicular in relation to the axis 19 of the device and connecting gradually to the surfaces located on either side of the ring-like space A. Inside the space EA3 the mixture circulates at a decreasing tangential speed towards the periphery. At the periphery of the space EA3 it leads to the space ED3 wherein it is brought back towards the axis 19 of the device, the space ED3 being included between two surfaces that are positioned more or less perpendicular in relation to the axis 19 of the device. The space ED3 is fitted with rectifying bladings R3 of which the geometry pursuant to a frontal view is diagrammed in FIG. 11B. The angle that is formed at one point of the blades between the tangent at the surface of the blades and the radius stemming from that point varies between a value which is close to 90°, at intake (angle D1) and a value close to 0°, at output (angle D2), which makes it possible to gradually cancel the tangential speed.

The device can be used with liquid, gaseous or even polyphase diaphase fluids.

Hence, the low pressure fluid to compress can be a gas or a vapor or in some instances a diaphase gas-liquid mixture.

The working fluid can also be either gas, or a liquid.

All combinations of instances thus mentioned can be accomplished in the following manner:

compression of a gas (or vapor), by using gas (or vapor) as a working fluid.

compression of a gas (or vapor), by using a liquid as a working fluid.

compression of a gas (or vapor), by using a liquid as a working fluid.

compression of a liquid, by using a gas (or vapor) as a working fluid.

compression of a liquid, by using a liquid as a working fluid.

Furthermore, as was shown, each one of the fluids can be diaphase.

In the case of compression of a gas (or vapor) by releasing a gaseous working fluid (or vapor), a high release ratio of the working fluid leads to supersonic outflow speed. In that case, the section of the ring-like zone, the nozzles or ducts with which the first zone I is probably fitted for distribution of the working fluid does not decrease constantly between intake and output of the working fluid, but goes through a minimum, the sonic point being located at the level of that minimal section, then it increases again.

After the mixing, the flow speed can be subsonic or supersonic. If it supersonic, the flow section in the third compression zone III must also go through a minimum first of all by reducing then by gradually increasing.

I claim:

1. A compression device for a fluid by the release of a working fluid which includes a first pocket wherein the working fluid circulates, a second pocket wherein the fluid to be compressed circulates, a third pocket in which the working fluid and fluid to be compressed mixture circulates, said mixture coming from a mixing pocket connected to said third pocket as well as to said first and second pockets, characterized in that said mixing pocket has a ring-like shape, and in that said first and second pockets are connected to said mixing pocket by passages that are formed to introduce in a substantially tangential manner said working fluid and said fluid to be compressed in said mixing pocket.

2. A device according to claim 1, characterized in that said mixing pocket with an average outer diameter and an average inner diameter restricting said pocket, characterized in that a ratio of said average outer diameter of the ring-like zone to the interval between said average outer diameter and said average inner diameter is at least equal to five.

3. A device according to one of claims 1 or 2, characterized in that said second pocket for distributing the fluid to be compressed includes a circular crown which is pierced with ducts that leads to the ring-like pocket, said ducts being regularly spaced on the periphery of said ring-like pocket, and being curved, so as to introduce the fluid to compress at a substantially tangential speed in the ring-like zone.

4. A device according to claim 1, characterized in that said third pocket for compressing the mixture of the two fluids coming from said mixing pocket includes a ring-like space wherein rectifying blades are placed which are adapted to gradually cancel the tangential speed element of said mixture by making the pressure increase.

5. A device according to claim 1, characterized in that said first pocket includes a series of converging nozzles that lead into the mixing pocket, said nozzles being regularly spaced so as to introduce the working fluid at a substantially tangential speed inside said mixing pocket.

6. A device according to claim 1, characterized in that said first pocket includes a circular crown which is pierced with ducts that lead onto said mixing pocket, said ducts being regularly spaced on the periphery of said mixing pocket, and ducts with a converging shape so as to communicate an increasing speed to the working fluid, said ducts also having a curved shape so as to introduce the fluid to compress at a substantially tangential speed inside said mixing pocket.

7. A device according to claim 1, characterized in that said first pocket includes a ring-like zone which is included between two conical surfaces of which the generators produce a different angle with the axis of the device so as to create said converging ring-like zone wherein the working fluid is introduced by a tangential intake at the level of the largest section and circulates at an increasing tangential speed up to the smallest section which communicates with said mixing pocket.

8. A device according to claim 1, characterized in that said third pocket for compressing the mixture of the two fluids coming from said mixing pocket includes, itself, a ring-like zone which is included between two conical surfaces of which the generators form different angles with the axis of the device, so as to create a diverging ring-like zone wherein the mixture of the two fluids coming from said mixing pocket leads to the level of the smallest section and circulates at a decreasing tangential speed up to the largest section.

9. A device according to claim 1 characterized in that said third compression pocket includes an initial space between two surfaces which are positioned substantially crosswise relative to the axis of the device and, wherein the mixture circulates at a decreasing tangential speed by being discharged at a periphery of said initial space, said initial space being followed by a second space which is also included between two surfaces positioned substantially crosswise relative to the axis of the device, and wherein the mixture is brought back towards the axis of the device by circulating at a decreasing tangential speed, said second space including rectifying blade means for enabling a gradual cancelling of the tangential speed of said mixture.

10. A device according to claim 1 characterized in that an angle of introduction of the working fluid in said first pocket for distributing the working fluid is altered when the debit of said working fluid varies, so as to maintain fairly constant the tangential circulation speed of said working fluid.

11. A device according to claim 1, characterized in that the working fluid is comprised of one of a gas and vapor.

12. A device according to claim 1 characterized in that the working fluid is comprised of a liquid.

13. A compression process for a fluid by the release of a working fluid, characterized in that the process includes the steps of:

causing said working fluid to enter inside an initial zone and circulate through a decreasing passage section at an increasing speed, leading into said initial zone at a pressure level which is lower than that of the low pressure fluid to be compressed, guiding said working fluid at the output of said initial zone in a substantially tangential direction, directing said low pressure fluid to be compressed into the ring-like zone in a substantially tangential direction by guiding the same through a second zone, mixing inside said second ring-like zone said working fluid with said fluid to be compressed by conferring to the mixture a tangential speed which is substantially uniform inside the entire ring-like zone, and supplying the mixture inside a third zone wherein the tangential speed is gradually cancelled, as the pressure rises correlatively.

* * * * *